US009433250B2

(12) United States Patent
Merchen

(10) Patent No.: US 9,433,250 B2
(45) Date of Patent: Sep. 6, 2016

(54) SHIRT HOLD-DOWN UNDERGARMENT

(71) Applicant: Heath Wayne Merchen, Oklahoma City, OK (US)

(72) Inventor: Heath Wayne Merchen, Oklahoma City, OK (US)

( * ) Notice: Subject to any disclaimer, the term of this patent is extended or adjusted under 35 U.S.C. 154(b) by 209 days.

(21) Appl. No.: 14/183,132

(22) Filed: Feb. 18, 2014

(65) Prior Publication Data

US 2015/0230531 A1 Aug. 20, 2015

(51) Int. Cl.
*A41F 17/00* (2006.01)

(52) U.S. Cl.
CPC ..... *A41F 17/00* (2013.01)

(58) Field of Classification Search
CPC ..... A41F 17/00–17/04; A41B 9/008; A41B 9/14; A41B 11/008; A41B 9/02; A41B 9/04; A61F 5/24–5/28
See application file for complete search history.

(56) References Cited

U.S. PATENT DOCUMENTS 1,286,037 A * 11/1918 Lichetti ..... A41B 9/08 2/400
2,114,222 A * 4/1938 Holben ..... A41F 19/00 2/337
RE21,624 E * 11/1940 Dann ..... A41B 9/002 2/406
2,837,748 A * 6/1958 Manning ..... A41F 9/00 2/221
3,091,238 A * 5/1963 De Bogory, Sr. ..... A61F 5/24 128/100.1
3,174,482 A * 3/1965 Parrott ..... A41B 9/02 2/404
3,524,449 A * 8/1970 Peters ..... A41C 1/00 128/96.1
4,074,364 A * 2/1978 Lucero ..... A41F 17/00 2/117
4,416,272 A * 11/1983 Nelkin ..... A61F 5/24 128/95.1
4,677,699 A * 7/1987 Barabe ..... A41F 9/025 2/221
5,857,947 A * 1/1999 Dicker ..... A63B 21/00069 2/69.5
6,622,719 B1 * 9/2003 Slautterback ..... A61F 5/24 128/98.1
6,684,410 B2 * 2/2004 Robinett ..... A41D 13/0015 2/228
8,381,314 B2 * 2/2013 Takamoto ..... A41D 7/00 2/243.1
2014/0304899 A1 * 10/2014 Almonte ..... A41B 9/001 2/403

* cited by examiner

*Primary Examiner* — Khaled Annis

(57) ABSTRACT

Disclosed herein is an undergarment designed to keep the wearers shirt tucked, that includes a body and an elastic band around the top of the body at the waist, elastic legbands at the bottom of the body, an elastic anchor on each side of the body each of which has its bottom attached to the top of the elastic legband on the same side and its top attached to the bottom of another elastic band around the hip that rests below the waistband.

5 Claims, 6 Drawing Sheets

SHIRT HOLD-DOWN UNDERGARMENT

The present invention is non-provisional.

FIELD OF THE INVENTION

The subject matter disclosed herein relates generally to undergarments. More particularly, the subject matter relates to an undergarment having an elastic shirt hold-down band attached to the leg bands of the undergarment by elastic anchor bands.

BACKGROUND OF THE INVENTION

Shirts or blouses often become fully or partially untucked due to movement of the wearer. The present device is designed as an undergarment that serves to keep the shirt or blouse tucked in without revealing the elastic hipband or waistband of the wearer.

"Shirt stays" are a device known in the art which connect the bottom of the wearer's shirt to the top of the wearer's hosiery or socks, consisting of two long elastic bands with a clip at both ends. The bands can chafe against the wearer's legs. Additionally, any device using a clip can, when enough pressure is placed on the device, come undone thereafter snapping against the wearer's unprotected skin and requiring the wearer to partially disrobe in order to reattach the device. Some clips will hold tightly enough that it will actually damage the shirt's fabric if enough pressure is applied. Additionally, other shirt hold-down devices are comprised of metal or plastic clips that fully attach to a shirt with the other end stitched into the undergarment, and some also contain metal pieces that allow adjustment, adding bulk to the undergarment and making it impractical to wear the undergarment if the clips are unused. Yet another shirt-hold down device is a completely separate restraint device worn over the undergarment which has straps that wrap around the inner groin area of the user, causing uncomfortable friction, especially during any type of long walk or exercise. Finally, yet another device is simply an elastic belt that goes over the shirt, but with nothing to keep the belt itself from riding up with the shirt.

Thus, a comfortable undergarment having an elastic shirt hold-down band without clips where the hold-down band is anchored to elastic legbands to evenly distribute pressure and keep the band and shirt from riding up, and where the undergarment can comfortably be worn even if no shirt or blouse is tucked, would be well received in the art. Additionally, if significant pressure is placed on the band, unlike a clip, the shirt will be released slightly and the wearer can retuck without disrobing.

INVENTION DESCRIPTION

According to one aspect of the invention, an undergarment comprises a body; an elastic waistband attached to the top of the body; elastic legbands attached to the bottom of the body; elastic anchors on either side of the body attached at the bottom to the legbands; and an elastic hipband attached at its bottoms to the elastic side anchors. The elastic hipband may also have small rubber strips on its interior.

BRIEF DESCRIPTION OF THE DRAWINGS

The subject matter which is regarded as the invention is particularly pointed out and distinctly claimed in the claims. The foregoing and other features and advantages of the invention are apparent from the following detailed description taken in conjunction with the accompanying drawings in which:

A detailed description of the hereinafter described embodiments of the disclosed apparatus and method are presented herein by way of exemplification and not limitation with reference to the Figures.

Figure 1:
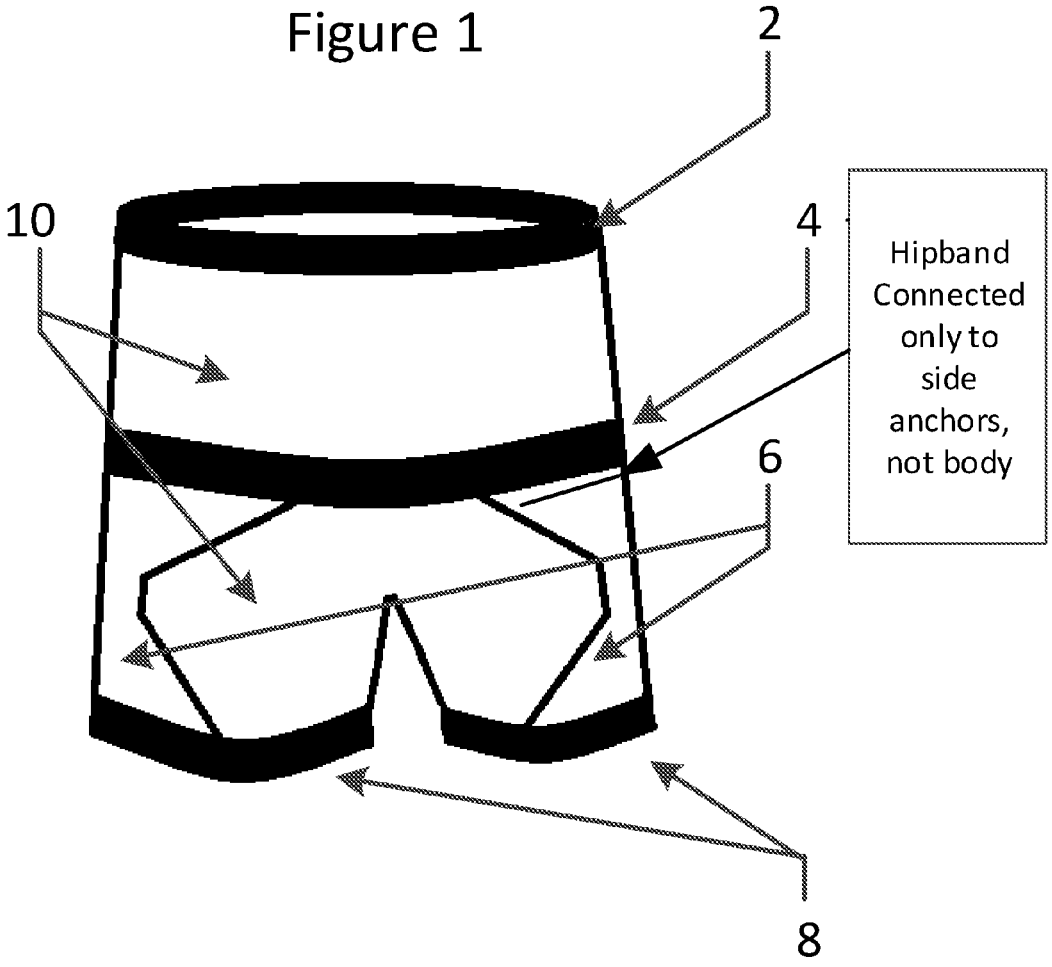
FIG. 1 depicts a perspective view of the front of a boxer brief undergarment.

Referring first to FIG. 1, a perspective view of a front side of a boxer brief undergarment is shown having two elastic anchor bands (6) attached to and extending form the bottom of the hipband (4) of the undergarment. The hipband (4) is attached only to the anchor bands (6) and not directly to the body (10). Each of the elastic anchors (6) extends and attaches to the top of the leg bands (8). The waistband (2) is above the hipband (4) and is attached to the body (10). The interior of the elastic hipband (4) presses against the fabric of a shirt (pictured in FIG. 4 as item 12) preventing the shirt from becoming untucked, or coming loose, due to the movements of a wearer.

Figure 2:
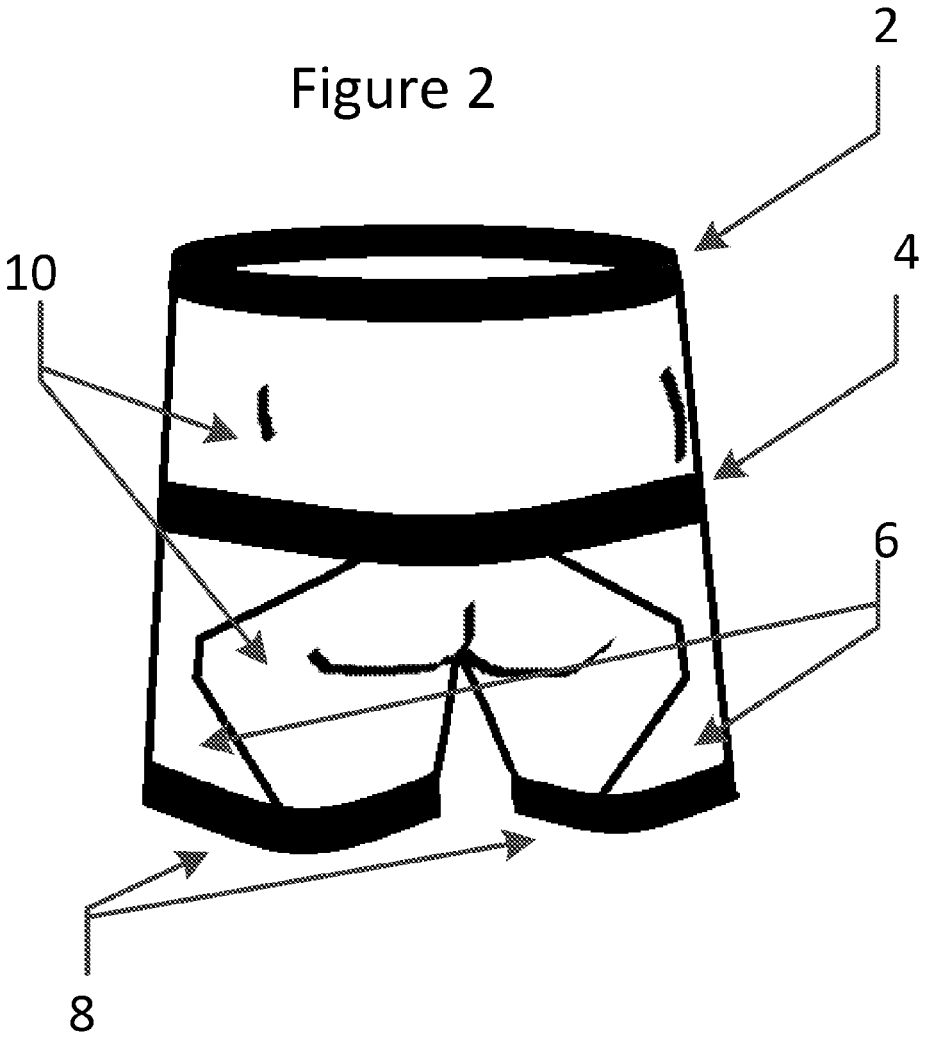
FIG. 2 depicts a perspective view of the back of the boxer brief undergarment of FIG. 1.

As shown in FIG. 2, a perspective view of the back side of a boxer brief undergarment, where the bottom of the waistband (2) is attached to the top of the body (10). The bottom of the body (10) is attached to the top of the leg bands (8). The bottom of the anchor bands (6) are attached to the top of the leg bands (8), and the top of the anchor bands (6) are attached to the bottom of the hip band (4). The hip band (4) is not directly attached to the body (10), but is only attached to the anchor bands (6).

Figure 3:
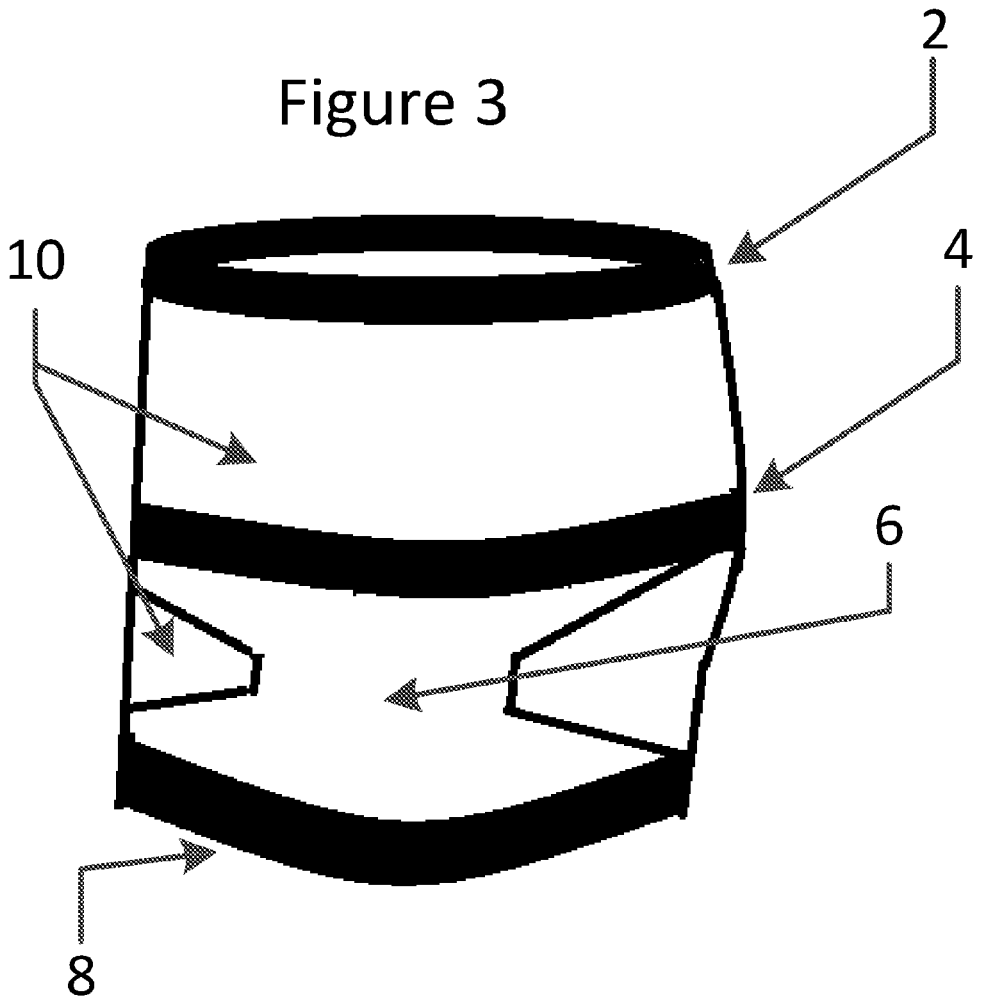
FIG. 3 depicts a perspective view of the left side of the boxer brief undergarment of FIG. 1.

FIG. 3, depicts a side perspective view of the boxer brief undergarment. The relative pieces are all attached in the same manner as is described above.

Figure 4:
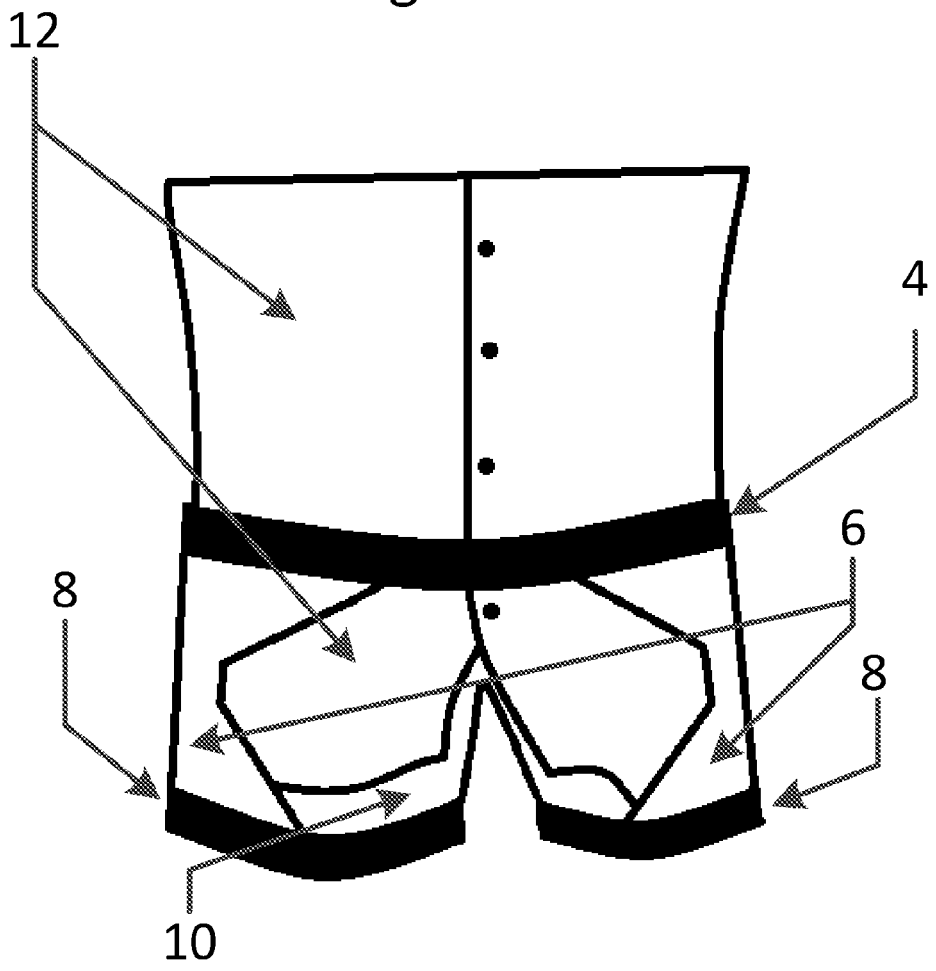
FIG. 4 depicts a front perspective view of the boxer brief undergarment of FIG. 1 showing a user wearing a shirt that is tucked below and restrained by the hipband.

FIG. 4 depicts a front view of a shirt (12) tucked into the undergarment, over the waistband (not pictured as it is covered) and under the hip band (4). The shirt also extends under the anchor bands (6). As in the prior depictions, the bottom of the anchor bands (6) are attached to the top of the leg bands (8), and the top of the leg bands (8) are also attached to the bottom of the body (10).

Figure 5:
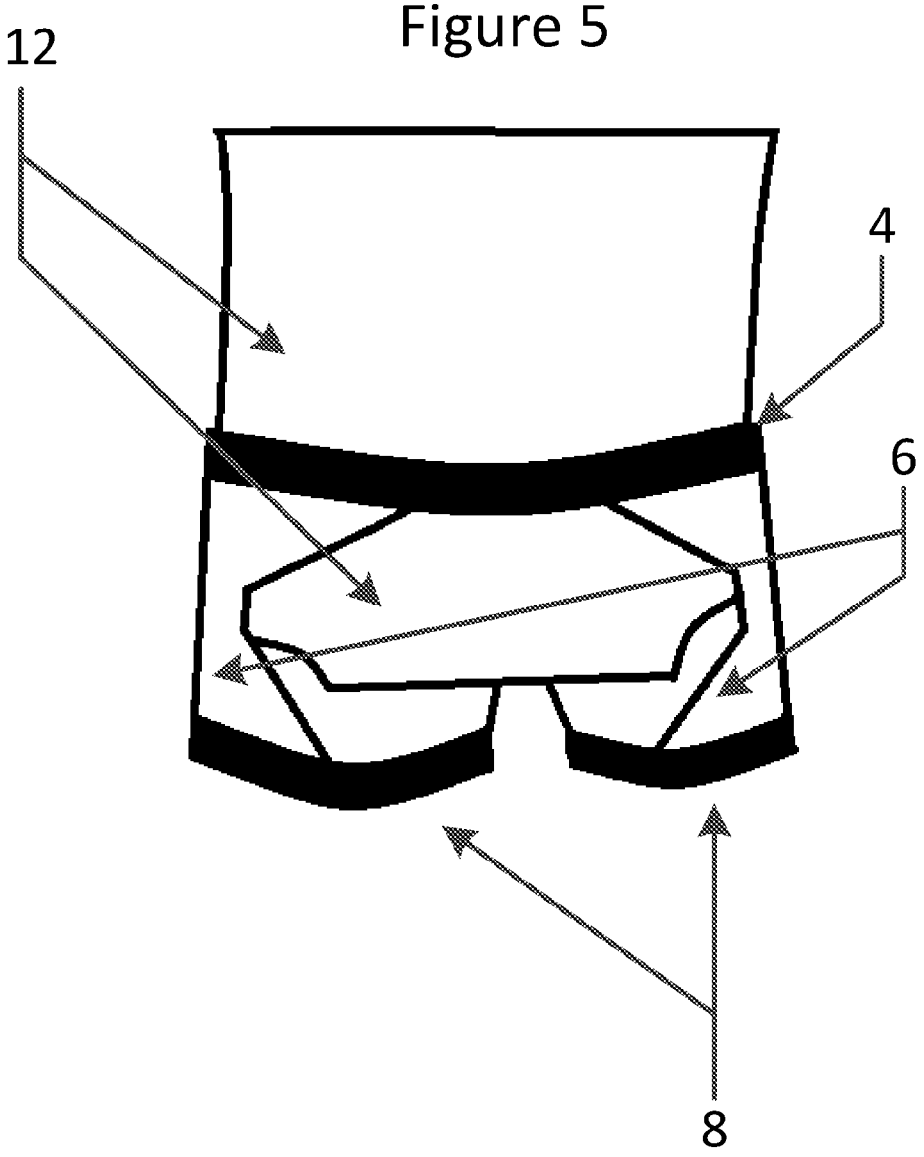
FIG. 5 depicts a rear perspective view of the boxer brief undergarment of FIG. 1 showing a user wearing a shirt that is tucked below and restrained by the hipband.

FIG. 5 similarly depicts a rear perspective view of a shirt (12) tucked into the undergarment, over the waistband (not pictured as it is covered) and under the hip band (4).

Figure 6:
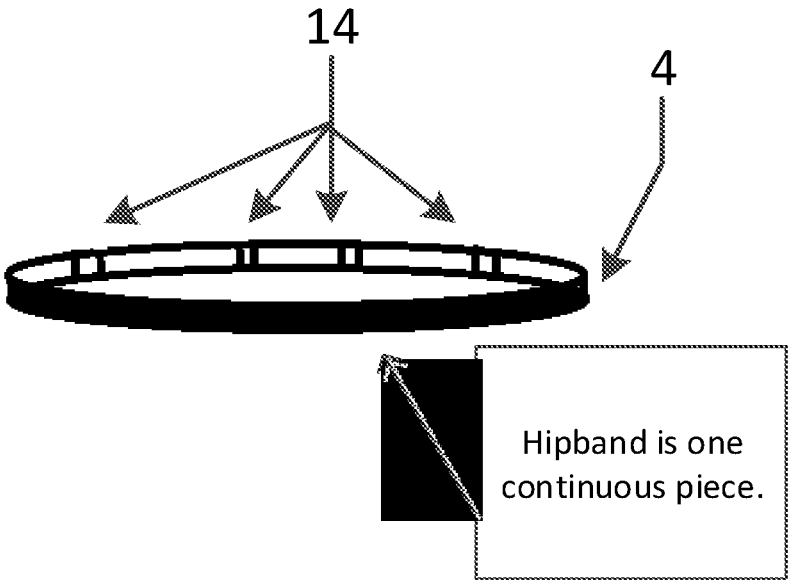
FIG. 6 depicts a front perspective view of the hipband section of the boxer brief undergarment of FIG. 1 showing small rubber strips on the interior of the hipband.

FIG. 6 depects the hip band (4) with friction inducing strips (14) attached to its interior. The strips (14), which are comprised of rubber or other friction inducing material, will press against the shirt or blouse of the wearer, ensuring that the clothing article remains tucked.

In one embodiment, the fabric anchors (6) comprise an elastic material. However, the anchor bands (6) may comprise any other appropriate material such as cotton, polyester, silk, wool or linen or other materials such as a synthetic or plastic. It should be understood that the hip band and anchor bands may be applied to other undergarments and that the boxer brief undergarment is shown for the purposes of exemplification.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An undergarment comprising a body having a right and left leg portions, a hip portion, a top and a bottom portions, right and left side portions adapted to be adjacent to right and left sides of a wearer when worn;

an elastic waistband attached to the top portion of the body;

a right and left leg bands;

a continuous elastic hip band encircling an entire circumference of the hip portion attached only to the two side anchors at the right and left side portions, wherein the two side anchors are attached at the a top portion of the hip band and at a bottom portion to the right and left elastic leg bands, and wherein the right and left elastic leg bands are attached to the bottom of the body;

wherein the elastic hip band has small rubber or other friction inducing strips or pieces of material attached to an interior of the elastic hip band;

wherein the undergarment is designed to keep a wearer's shirt tucked in without revealing the elastic hip band or the waistband of a wearer.

2. The undergarment of claim 1, wherein the elastic hip band is attached to a top of the right and left elastic leg bands by a piece of fabric of any width.

3. The undergarment of claim 1, where the elastic hip band is of a variety of widths and distances from the waistband.

4. The undergarment of claim 1, wherein the body of the undergarment is selected from the group consisting of a panty, a brief, a boxer brief, an athletic brief, a bicycle short, long underwear, long athletic support undergarments, or short athletic support undergarments.

5. The undergarment of claim 1, wherein the waistband, hip band, side anchors, and leg bands are selected from a variety of cloths, fabrics, plastics, elastics, or stitches.

* * * * *